US005344243A

United States Patent [19]

Sawa et al.

[11] Patent Number: 5,344,243

[45] Date of Patent: Sep. 6, 1994

[54] HEAD WIRE AND MANUFACTURING PROCESS THEREOF

[75] Inventors: Tsutomu Sawa, Fujisawa; Hiroyuki Takenoshita, Yokohama; Kohei Shibata, Isehara; Hirohide Komatsu, Machida, all of Japan

[73] Assignees: International Business Machines Corporation, Armonk, N.Y.; K.R.D. Corporation, Kanagawa, Japan

[21] Appl. No.: 3,198

[22] Filed: Jan. 11, 1993

Related U.S. Application Data

[63] Continuation of Ser. No. 835,630, Feb. 13, 1992, abandoned.

[30] Foreign Application Priority Data

Jun. 18, 1991 [JP] Japan ..... 3-173172

[51] Int. Cl.[5] ..... B41J 2/23

[52] U.S. Cl. ..... 400/124.32; 101/93.05

[58] Field of Search ..... 400/124; 101/93.05; 76/107.1, 119

[56] References Cited

FOREIGN PATENT DOCUMENTS 0193166 11/1983 Japan ..... 400/124 WD
0274957 12/1986 Japan ..... 400/124 WD
2199461 9/1987 Japan ..... 400/124 WD

*Primary Examiner*—Edgar S. Burr
*Assistant Examiner*—John S. Hilten
*Attorney, Agent, or Firm*—Anderson Kill Olick & Oshinsky

[57] ABSTRACT

A head wire for use in a high-speed impact dot matrix printer head, having an elongated body, made of a high speed steel wire material or titanium alloy wire material. One end of the body is connectable to an armature of the printed head and a second end on an ink ribbon for printing characters on a paper material. The second end has a coating formed around its periphery and consists of a ceramic hard titanium compound or an aluminum oxide.

2 Claims, 5 Drawing Sheets

FIG. 4
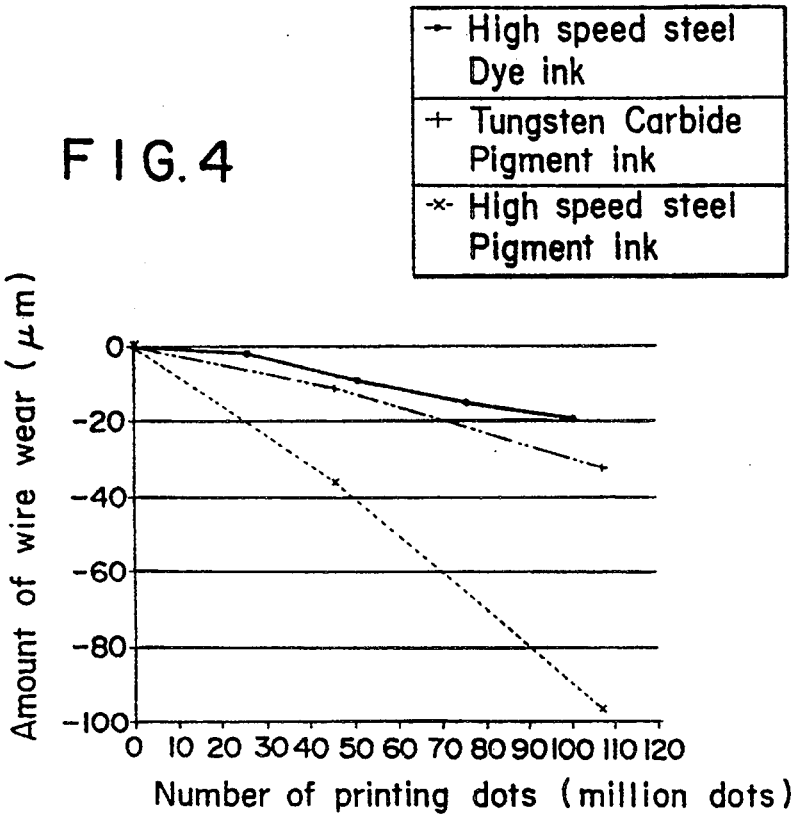
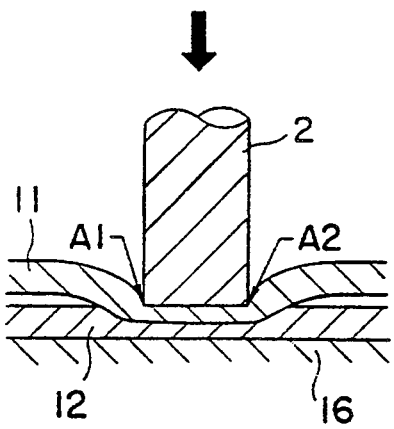
FIG. 5(a)
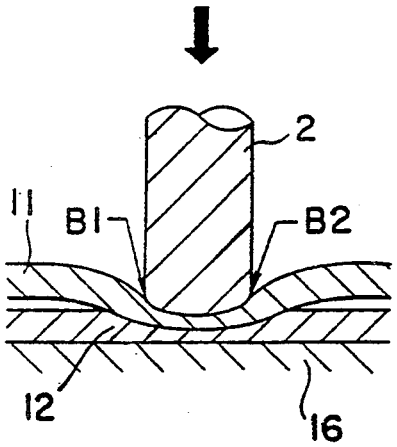
FIG. 5(c)
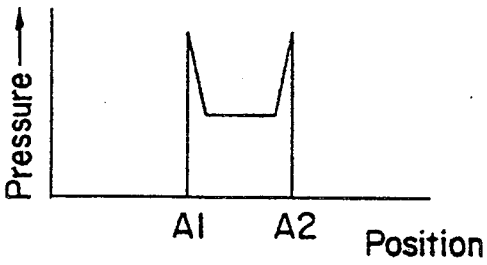
FIG. 5(b)
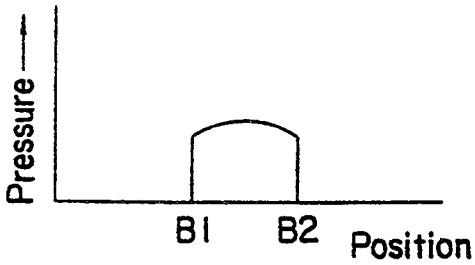
FIG. 5(d)

FIG. 8(b)
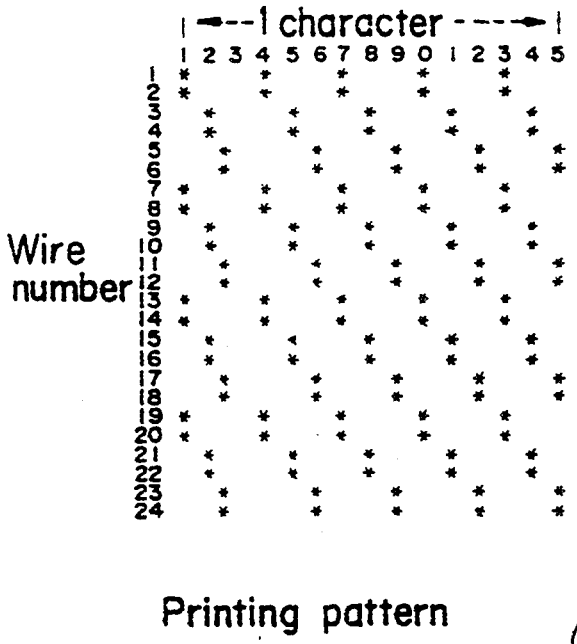
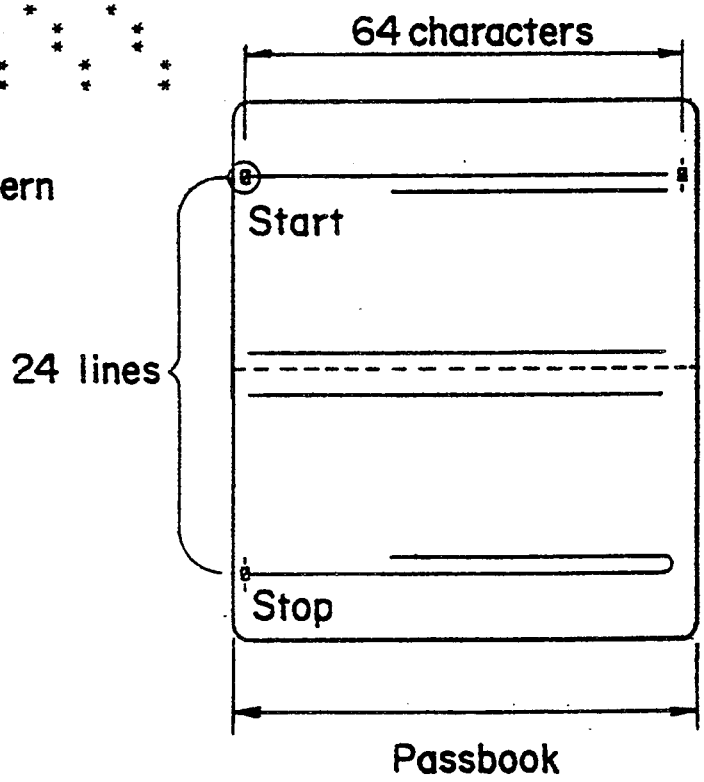
FIG. 8(a)

HEAD WIRE AND MANUFACTURING PROCESS THEREOF

This is a continuation application Ser. No. 07/835,630, filed Feb. 13, 1992, now abandoned.

BACKGROUND OF THE INVENTION

This invention relates to a head wire constituting an impact dot matrix print head and a process for its production.

An impact dot matrix printer head is used to print characters by making head wires project using the attraction generated by an electromagnet (the clapper type) or the force-releasing elastic energy stored in a spring (the spring charge type), and by conveying the force to the paper through an ink ribbon to transfer the ink onto the paper.

As FIGS. 1 and 2 show, the print head 1 of the spring charge type is manufactured by brazing a specified number of head wires 2 onto armatures 4 through bars 3, and by welding these armatures 4 to springs 5. Furthermore, the springs 5 are built into the magnetic circuit together with yokes 7 with a predetermined offset to core 6.

The armature 4 is always attracted toward the core 6 by the permanent magnet 8, and accumulates elastic energy. By exciting the coil 9 in synchronization with the printing timing, the magnetic field of the permanent magnet 8 is canceled, and the resilience energy stored in the spring 5 is converted into kinetic energy. Due to this, the head wire 2 is projected through the wire guide 10*a* at the end of the head, and transfers ink onto the paper 12 on the plates 16 through the ink ribbon 11. Here, the distance of the movement of the head wire 2 is about 0.25 to 0.40 mm.

In such a print head 1, as FIG. 3 shows, the end of the head wire 2 is caved into the ink ribbon 11 and the edge is worn out by abrasion after repeated printings. As wear advances further, the distribution of contact pressure with the ink ribbon 11 increases in the central part, and finally, the central part of the head wire 2 becomes worn out, and the length of the head wire 2 is decreased by the amount of wear w.

Thus, the shortened head wire 2 increases the gap with the paper 12, lowering the printing pressure. Since the end of the head wire 2 is rounded, the printing dot diameter decreases, and the printing becomes less dense and more unclear.

Furthermore, a head wire 2 with a rounded end may pierce the fabric of the ink ribbon 11, breaking the ink ribbon 11 easily, and the end of the head wire 2 may break if the head wire 2 is caught by the ink ribbon 11.

To decrease the wear of the end of the head wire, harder materials have been used for the head wire, or "dye ink" has been used as the ink impregnated in the ink ribbon.

When hard tungsten carbide (cemented carbide) is used as the material for the head wire, although a decrease in wear can be realized, the mass of the head wire increases and cannot keep up with increased printing speeds. In spite of its hardness, it has low tenacity, resulting in easy breakdown of the head wire.

Since the main cause of the wear of the end of the head wire is abrasive wear due to the carbon black pigment contained in the ink, the pigment content has been minimized while the content of the dyes has been increased, preventing the wear of the end of the head wire. This is called "dye ink", while conventional ink is called "pigment ink" to discriminate between them.

Although the use of this "dye ink" decreases the wear of the head wire, printing is less dense and more unclear than printing with "pigment ink", which excels in clearness, longevity and quick drying properties, and the like of the ink ribbon is shortened.

The differences in head wire wear between the head wire materials and between inks impregnated in the ink ribbon are shown in FIG. 4. This graph shows the results of tests using an IBM 5577 printer.

By the above mentioned reasons, in the print head for high speed printing a high speed steel with quick response and high tenacity is used as the head wire, and in the ink ribbon a dye ink is used as the ink impregnated.

However, even if dye ink is used, the wear of the end of as head wire made of high speed steel is still large, and the head gap must be readjusted periodically. For applications requiring a high volume of printing, the print head itself must be replaced.

Furthermore, as a result of using dye ink, the printing is thin and unclear, and the life of the ink ribbon is short.

To decrease the wear of the end of the head wire and to solve the above problems, methods have been proposed in which a cemented carbide tip is fixed on the end of a head wire made of high speed steel, or in which a head wire made of high speed steel is covered with a cemented carbide ring; however, all of these methods have problems from the view point of reliability, processability and production costs, and have been used practically.

SUMMARY OF THE INVENTION

It is the object of this invention to provide a head wire with the same quick response and tenacity as conventional head wires made of high speed steel, and yet with greatly improved wear resistance.

It is another object of this invention to provide a method for producing a head wire than sufficiently satisfies the requirements of reliability and production costs.

In order to attain these objects the head wire of this invention is formed by a wire material made of high speed steel as in conventional head wires, and a ceramic hard coating such as TiAlN is formed only on the periphery of the end of the head wire and not on the free end surface of the head wire.

In the method for producing the head wire according to this invention, high speed steel is used as the material to form the wire material of the specified dimensions, and a ceramic hard coating is formed only around the periphery of the end of the wire material by a cold surface treatment method such as the sputter ion plating (SIP) method.

BRIEF DESCRIPTION OF THE DRAWING

FIG. 4 is a diagram illustrating the differences in the amount of wear of the end of a head wire caused by differences in the material of the head wire, and in the ink impregnated in the ink ribbon.

FIGS. 5(*a*), (*b*), (*c*) and (*d*) are diagrams illustrating the mechanism of wear of the end of a head wire.

FIG. 8 is a diagram illustrating the method of the printing test.

DETAILED DESCRIPTION OF THE INVENTION

Here, the mechanisms of the wear of a head wire are considered.

As FIG. 5 shows, the head wire 2 fixed on the spring 5 compresses the ink ribbon 11 and the paper 12 at a predetermined pressure.

For an initial head wire 2 which has not been worn out, as FIGS. 5(*a*) and (*b*) show, pressure is the highest at the periphery of the end of the head wire, and is at an almost even low pressure at the internal portions.

Since the ink ribbon 11 and the paper 12 are depressed, the head wire and the ink ribbon cause a large slippage at the periphery of the end of the head wire, and since the ink ribbon 11 is wound slowly, thereby also cause slippage with regard to the end of the head wire as a whole.

Due to this pressure and slippage, the pigment (carbon black) contained in the ink acts as a abrasive and abrades the edge of the end of the head wire.

As FIG. 5(*c*) and (*d*) show, when the edge of the end of the head wire is abraded and rounded, the pressure at the periphery of the end of the head wire decreases, resulting in an increase of pressure on the central portion.

Thus, the shape of the end of the head wire with equal rate of wear at all portions is determined, and thereafter, the head wire is worn out evenly maintaining this shape, and the total length of the head wire is decreased.

If a ceramic hard coating is formed on the periphery of the end of the head wire to improve the wear resistance, the rate of wear of the periphery of the end of the head wire can be decreased, and since the periphery is not abraded, the elevation of the pressure on the internal portions of the end of the head wire can be prevented.

Thus, the wear process for the entire end of the head wire is thought to be a repetition of a microscopic phenomena, in which the abrasion of the periphery results in the abrasion of internal portions, and the rate of wear of the entire end of the head wire is determined by the rate of wear of the periphery.

Figure 10A:
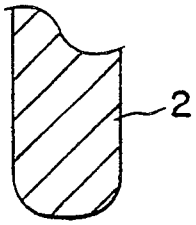
FIGS. 10(*a*) and (*b*) show an enlarged vertical cross-sectional view of the worn shape of the end of a head wire.
Figure 10B:
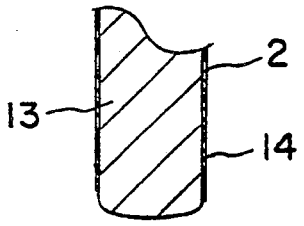

At the same time, since the ceramic hard coating on the end of the head wire has higher wear resistance than the internal portions of the end, the contact pressure of the periphery is always kept higher than that of the internal portions to maintain an equal rate of wear, and the end is worn out under a condition of equilibrium with the internal portions. Thus, as FIG. 10(*b*) shows, the edge of the end of a head wire with a ceramic hard coating is less rounded and has a flatter surface than the head wire without a ceramic hard coating shown in FIG. 10(*a*).

It is concluded from the above facts that the wear resistance of the end of the head wire is due to the wear resistance of the hard ceramic hard coating formed on the periphery of the end of the head wire, and that the wear resistance is not greatly improved by coating the end circular surface of the head wire which is worn out initially.

Figures 11A, 11B, 11C:
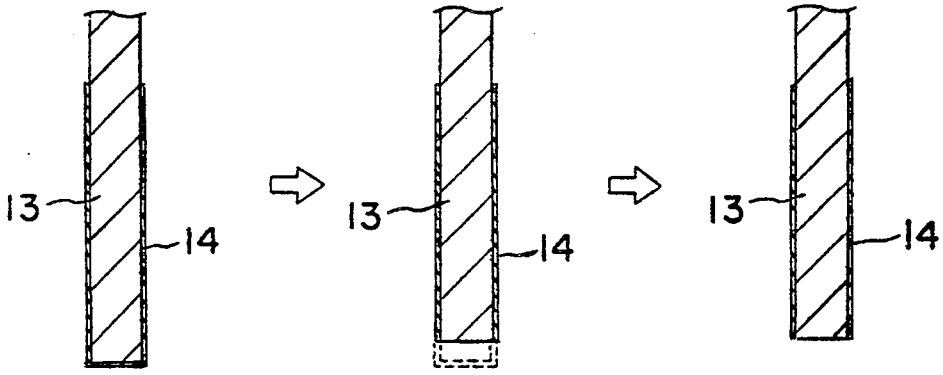
FIGS. 11(*a*), (*b*) and (*c*) show an enlarged vertical cross-sectional view illustrating the grinding process of the end of a head wire.

In the present manufacturing process for print heads, since the ends of all head wires are ground to equalize the length after assembly as FIG. 11 shows, the ceramic hard coating which has covered the entire surface of the end of the head wire are partially abraded off and removed together with the wire material.

To coat the entire surface of the ends, coating must be performed on the print head after the grinding process. However, this coating is not essential for the above reasons, and a change in the process which increases manufacturing costs is not required.

Figure 6:
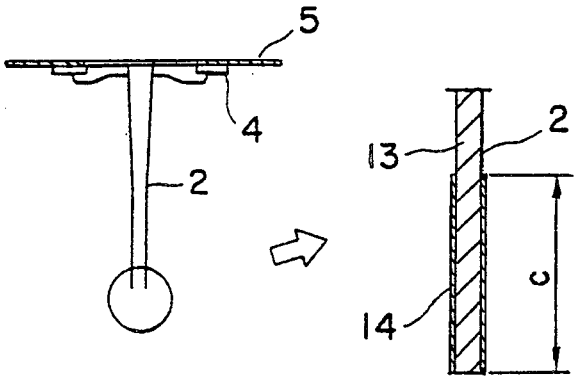
FIG. 6 shows an enlarged vertical cross-sectional view of the end of a head wire according to this invention.

This invention is based on these concepts, and the head wire 2 of this invention is formed by a wire material 13 made of high speed steel as in conventional head wires, and as in FIG. 6 shows, a ceramic hard coating 14 such as TiAlN is formed only on the periphery of the end of the head wire 2 and not on the free end surface of the head wire.

The materials of the ceramic hard coating 14 may include nitrides, carbonitrides, carbides, and oxides such as TiN, TiCN, TiC, and $Al_2O_3$, as well as TiAlN, and the thickness of the coating may be about 1 to 5 microns.

The use of high speed steel as the wire material as in conventional head wires is to minimize the mass of the head wire 2, to maintain quick response and high tenacity, and to prevent the breakdown of the head wire 2.

By optimizing the hardening conditions, the resistance to breakdown of the head wire made of high speed steel can further be improved.

Various tool steels, alloy steels, spring steel, titanium and its alloys may be used as wire materials as well as high speed steel.

The properties of various wire materials are shown in Table 1.

The reason why the ceramic hard coating 14 is formed only on the end of the head wire 2 is to prevent an increase in the mass of the head wire 2 and a decrease in the tenacity thereof as much as possible.

Since the head wire 2 slides along the wire guide 10*a* on the end of the print head 1, it is preferred to form the ceramic hard coating 14 up to the portion that said head wire 2 slides in contact with the wire guide 10*a*.

In the method for producing the head wire according to this invention, high speed steel is used as the material to form the wire material 13 of the specified dimensions, and a ceramic hard coating 14 is formed only around the periphery of the end of the wire material 13 and not on the free end surface of the wire head by a cold surface treatment method such as the sputter ion plating (SIP) method. The temperature in the oven at this time is normally about 150° to 200° C.

The sputter ion plating (SIP) method comprises the steps of an ion etching process for cleaning the surface of the material to be treated by the bombardment of Ar ions, and a coating process for forming the ceramic hard coating.

During these processes, the material to be treated is exposed to plasma, and always bombarded by Ar ions and atoms to be evaporated. By this bombardment, the kinetic energy of the particles are converted to heat energy (Joule heat), and the material to be treated is heated. The rate of temperature elevation varies depending on the mass of the material, and when a material with a small mass, such as the head wire 2, is treated, the temperature rises to 500° to 600° C. causing heat deformation.

Figure 7A:
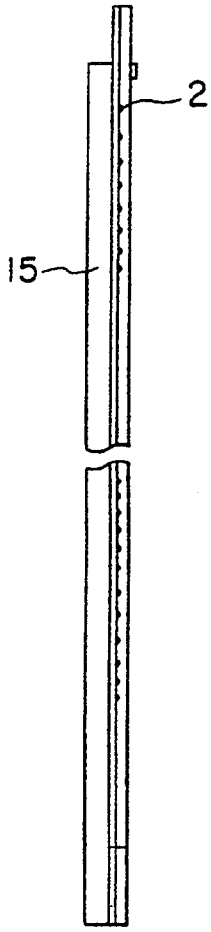
FIGS. 7(*a*), 7(*b*) and 7(*c*) are diagrams illustrating a jig used in the method for producing a head wire according to this invention.
Figure 7B:
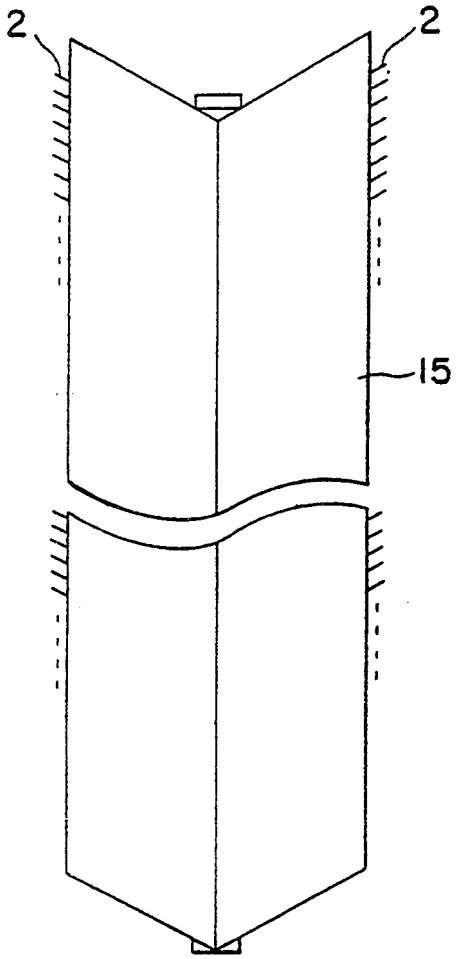
Figure 7C:
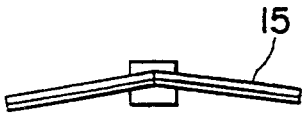

Therefore, a jig 15 as shown in FIG. 7 is used to prevent the deformation or softening of the head wire 2.

The head wires 2 are inserted in and fixed to the both sides of the jig 15 exposing only the portion to be coated, and are coated with ceramic hard coating 14. In this way, masking is performed and at the same time, the mass of the material to be treated is increased to prevent temperature elevation as much as possible.

The reason why a cold surface treatment method such as the sputter ion plating (SIP) method is used is that this method can produce a ceramic hard coating 14 with more uniform thickness in the radial direction than other methods. The quality of the head wire 2 produced by this method is highly reliable.

As the cold surface treatment method, the ion plating method or plasma CVD method may be used as well as the sputter ion plating (SIP) method.

The reason why the method of forming a ceramic hard coating 14 is adopted is that the bonding strength of the wear resistant layer is high, processing is relatively easy, and production costs are relatively low compared to a method fixing or coating the wire material 13 with other members.

Since the head wire of this invention is made of a high speed steel wire material coated with a ceramic hard coating formed only on the periphery of the end portion, the wear resistance of the end of the head wire can be improved to a large extent while maintaining the quick response and high tenacity of high speed steel, and breakage of the ink ribbon and breakdown of the end of the head wire can be prevented.

Furthermore, since the wear resistance of the end of the head wire has been improved to a large extent, pigment ink may be used as the ink to be impregnated in the ink ribbon, resulting in clearer printing.

Since the method of producing a head wire according to this invention is to form a ceramic hard coating using a cold surface treatment method only around the end of a head wire made of high speed steel, temperature rise during coating formation can be prevented as much as possible even for a head wire with an extremely low heat capacity, and deformation or softening of the head wire is prevented.

By using a cold surface treatment method such as the sputter ion plating (SIP) method, the thickness of the ceramic hard coating may be made uniform in the radial direction, and the quality of the head wire produced is reliable.

Furthermore, since the ceramic hard coating is formed around the wire material, and no different member is fixed or used for coating, the bonding strength is high, processing is relatively easy, and the production costs are relatively low.

EXAMPLE

Printing tests were performed to compare the amount of wear of the head wire of this invention and a conventional head wire. The results of the tests are as follows:

EXAMPLE 1

Figure 1:
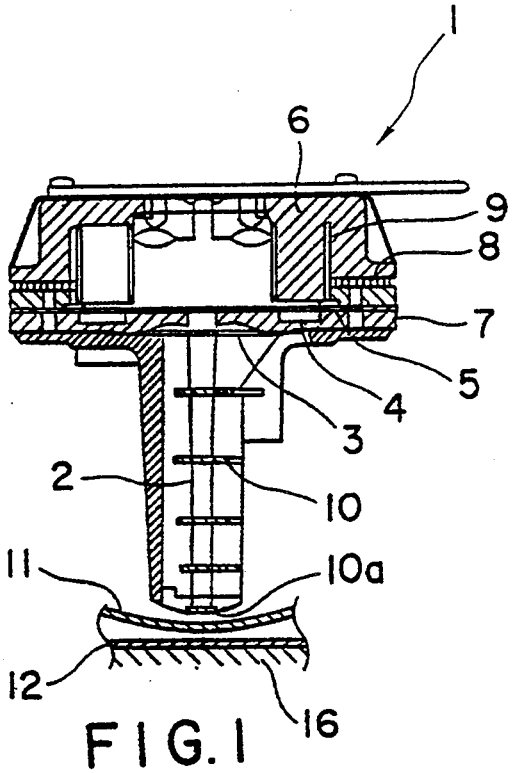
FIG. 1 shows a vertical cross-sectional view of a head wire of the spring charge type print head.
Figure 2:
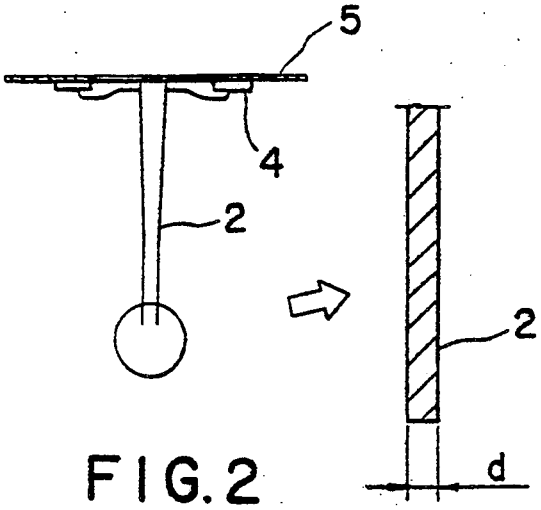
FIG. 2 shows an enlarged vertical cross-sectional view of a conventional head wire.
Figures 3A, 3B, 3C:
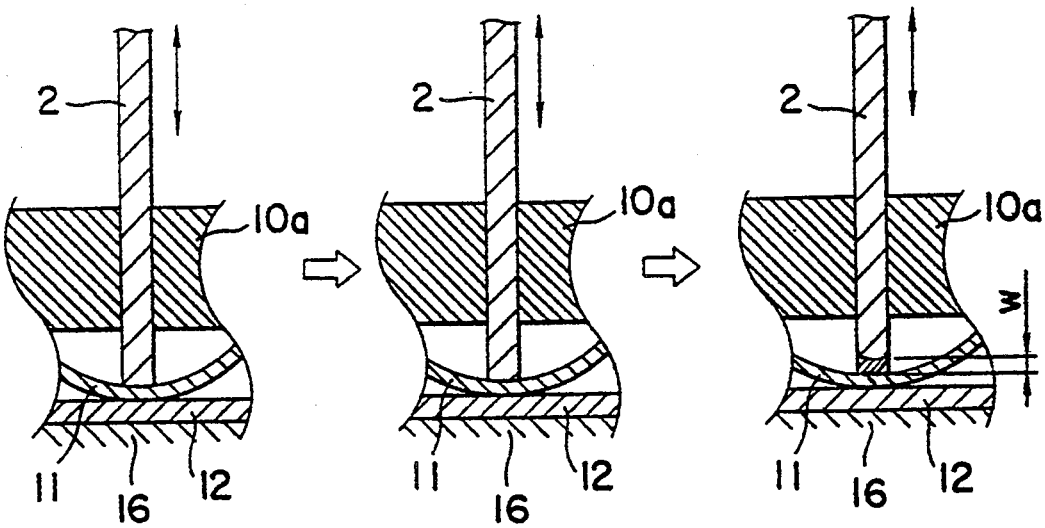
FIGS. 3(*a*), 3(*b*) and 3(*c*) show an enlarged vertical cross-sectional view illustrating the process of wear of the end of a head wire.

The head wire 2 was made of high speed steel, and as FIG. 2 shows, the diameter d of the end was 0.2 mm.

The printing tests were performed under the following test conditions and by the following test method and printing amount:

Test conditions

| | |
|---|---|
| Printer | IBM 4713-E02<br>Passbook Printer |
| Print head | Spring charge type<br>24-dot impact print head |
| Ink ribbon cartridge | for IBM 4713-E02(dye ink) |
| Form | Passbook (10 pages) |
| Environment | Room temperature |
| Printing pattern | See FIG. 8 |
| Head gap | 0.28 mm |

Test method

After printing from the first line to the 24th line of a passbook, the print head is returned to the first line of the same page, and printing is repeated five times, then moved to the next page. A passbook has 10 pages.

Printing amount

Each head wire uses five dots to print a character, and a line consists of 64 characters. The printing amount for a passbook is 0.384 million dots (5 dots×64 characters×24 lines×5 times×10 pages=0.384 million dots).

Since the head gap of a normal passbook printer must be set wider, and the depression of the passbook is larger than for a general-purpose printer, the wear of the head wire 2 was 3 to 4 times more than that of a head wire used in a general-purpose printer (when compared to the above IBM 5577 Printer).

Figure 9:
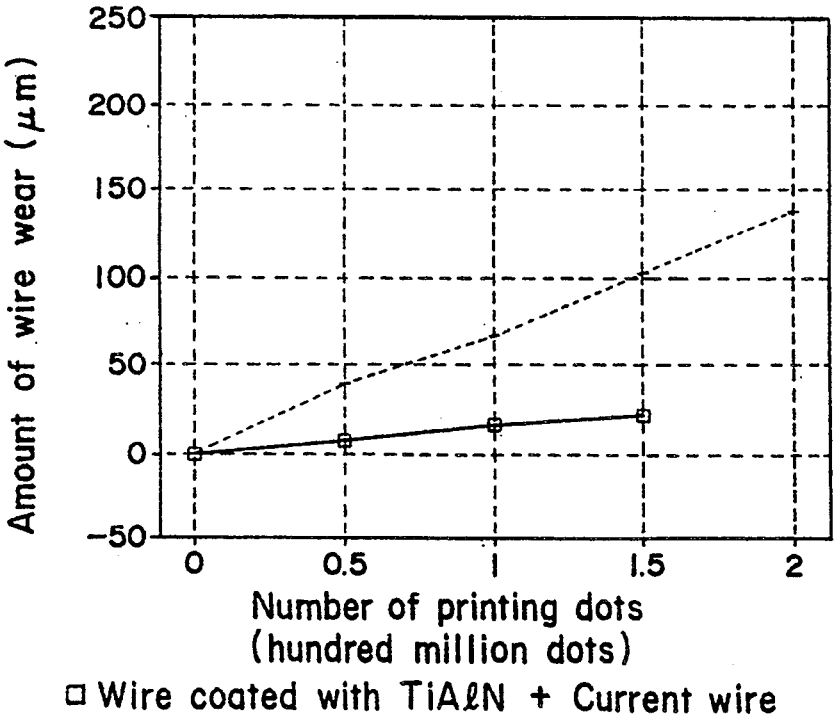
FIG. 9 is a diagram illustrating the relationship between the number of dots printed and the wear of the end of a head wire.

The test results are shown in Table 2 and FIG. 9.

The amount of wear w on the end of the head wire 2 without the ceramic hard coating was 65.8 microns after printing 100 million dots, 102.4 microns after printing 150 million dots, and 138.5 microns after printing 200 million dots. The life of the head wire 2 was about 200 million dots.

EXAMPLE 2

A high speed steel wire material 13 with the end diameter d of 0.2 mm was used as the head wire 2, and a TiAlN coating 14 with thickness of 1 micron was formed on the periphery 5 mm from the end by the sputter iron plating(SIP) method.

The other conditions were the same as those of the above EXAMPLE 1, and the printing tests were performed.

The test results are shown in Table 2 and FIG. 9.

The amount of wear w of the end of the head wire 2 was 16.8 microns after printing 100 million dots, and 22.2 microns after printing 150 million dots, which was about 1/5 of the comparative example, indicating a great reduction of amount of wear w.

TABLE 1

| Material | Hardness (Hk) | Coefficient of Friction | Specific Gravity |
|---|---|---|---|
| High speed steel | 800 max | 0.75–1.0 | 7.8 |
| Tungsten Carbide | 1600 max | 0.6 | 12–14 |

TABLE 1-continued

| Material | Hardness (Hk) | Coefficient of Friction | Specific Gravity |
|---|---|---|---|
| High speed steel coated with TialN | 2000–2500 | 0.5 | 7.8 |

TABLE 2

| Number of dots | Amount of wire wear (μm) | |
|---|---|---|
| | Wire coated with TiAlN | Current wire |
| 50 million dots | 7.3 | 39.8 |
| 100 million dots | 10.8 | 65.8 |
| 150 million dots | 22.2 | 102.4 |
| 200 million dots | | 138.5 |

We claim:

1. A head wire for use in a high-speed impact dot matrix printer head including an armature, said head wire, comprising:

an elongate body formed of one of a high speed steel wire material and a titanium alloy wire material;

a first end connectable to the armature and a second end having an end surface for printing characters on a paper material by acting on an ink ribbon arranged above the paper material; and a coating formed around only the perimetric periphery of said second end, wherein said end surface is not coated, said coating comprises one of a ceramic hard titanium compound and an aluminum oxide.

2. The head wire according to claim 1, wherein said coating has a thickness of about 1 micron to 5 microns..

* * * * *